US011286631B2

(12) United States Patent
Adler et al.

(10) Patent No.: US 11,286,631 B2
(45) Date of Patent: Mar. 29, 2022

(54) METHOD AND SYSTEM FOR A STATIC FLOODWALL SYSTEM

(71) Applicant: RSA Protective Technologies, LLC, Claremont, CA (US)

(72) Inventors: Richard S. Adler, Claremont, CA (US); Roderic A. Ellman, Jr., New York, NY (US); Risto Salo, Valencia, CA (US)

(73) Assignee: RSA Protective Technologies, LLC, Claremont, CA (US)

( * ) Notice: Subject to any disclaimer, the term of this patent is extended or adjusted under 35 U.S.C. 154(b) by 0 days.

(21) Appl. No.: 16/741,940

(22) Filed: Jan. 14, 2020

(65) Prior Publication Data

US 2021/0214905 A1 Jul. 15, 2021

(51) Int. Cl.
*E02B 3/10* (2006.01)
*E04H 17/16* (2006.01)
*E06B 3/70* (2006.01)

(52) U.S. Cl.
CPC ..... *E02B 3/10* (2013.01); *E04H 17/16* (2013.01); *E06B 3/70* (2013.01)

(58) Field of Classification Search
CPC ..... E04H 9/145; E02B 3/10; E02B 3/106
See application file for complete search history.

(56) References Cited

U.S. PATENT DOCUMENTS 944,210 A * 12/1909 Rhodes ..... E04H 17/00 49/10
1,714,949 A * 5/1929 Collier ..... E02D 5/10 405/253
2,420,228 A * 5/1947 Condon ..... E02B 3/066 405/286
5,118,217 A * 6/1992 Younes ..... E02B 3/102 405/114
5,244,309 A * 9/1993 Murdock ..... E02B 7/005 405/114
5,439,316 A * 8/1995 Richardson ..... E02B 3/106 405/114
5,460,462 A * 10/1995 Regan ..... E02B 3/104 405/96

(Continued)

FOREIGN PATENT DOCUMENTS

CN 103362104 A 10/2013
KR 10-2015-0042964 A 4/2015

OTHER PUBLICATIONS

International Search Report dated May 28, 2021 in corresponding International Application No. PCT/US2021/013516.

*Primary Examiner* — Benjamin F Fiorello
(74) *Attorney, Agent, or Firm* — Jon E. Gordon; Haug Partners LLP

(57) ABSTRACT

A static floodwall system that includes at least one floodwall section, and may include an access gate. The access gate may include a motor, control box, and drive system for moving a gate panel between open and closed positions. The static floodwall system may further include a plumbing system for transporting rain water from a dry side to a wet side. The floodwall system may be installed such that it is surface mounted, requiring minimal excavation. Methods of installing the floodwall system include creating a shallow excavation, adding compact fill and a top layer to the excavation site, and installing the floodwall section(s) on the top layer.

22 Claims, 10 Drawing Sheets

(56) References Cited

U.S. PATENT DOCUMENTS 6,042,301 A * 3/2000 Sovran ..... E02B 7/22 405/112
6,164,870 A * 12/2000 Baruh ..... E02B 3/108 405/114
6,338,594 B1 * 1/2002 Adler ..... B82Y 10/00 405/104
6,732,479 B2 * 5/2004 Nomura ..... E02B 3/102 256/13
7,121,764 B2 * 10/2006 Rorheim ..... E02B 3/102 405/107
7,214,005 B1 * 5/2007 Davis ..... E02B 3/102 405/114
7,364,385 B1 * 4/2008 Luke ..... E02B 3/102 405/107
7,896,582 B2 * 3/2011 Chouery ..... E02D 29/02 405/286
7,980,791 B1 * 7/2011 Sine ..... E02D 29/0233 405/284
9,562,336 B2 * 2/2017 Adler ..... E02B 3/108
9,670,633 B1 * 6/2017 Thieding ..... E02B 3/102
9,885,162 B1 * 2/2018 Munz ..... E02B 3/102
10,036,133 B2 * 7/2018 Adler ..... E02B 7/26
10,161,093 B2 * 12/2018 Adler ..... E02B 3/102
2004/0098937 A1 * 5/2004 Blake ..... E04H 9/145 52/302.6
2007/0077123 A1 * 4/2007 Williams ..... E02B 3/106 405/107
2010/0129156 A1 5/2010 Taylor
2012/0204498 A1 * 8/2012 Richey ..... E02B 3/106 52/102
2014/0270990 A1 * 9/2014 Heraty ..... E02D 29/0266 405/286
2015/0152617 A1 * 6/2015 Rodriguez ..... E02B 11/00 405/38
2015/0211204 A1 * 7/2015 Baumgartner ..... E02D 29/0266 405/287
2015/0337583 A1 * 11/2015 Fukagawa ..... E06B 5/10 49/23
2016/0090706 A1 * 3/2016 Johnson, Jr. ..... E01C 11/221 405/114

* cited by examiner

METHOD AND SYSTEM FOR A STATIC FLOODWALL SYSTEM

FIELD OF THE INVENTION

The invention disclosed herein relates generally to a static floodwall system for flood prevention, and methods of installation and use thereof.

BACKGROUND

Conventional floodwalls represent permanent structures with fixed heights to protect buildings or lands from flood damage. In order to resist the flood waters, such conventional floodwalls have deep foundations, typically with a required excavation depth of at least the above-ground height of the floodwall, and if ground soil is poor an even deeper foundation including sheet/straight or batter piles. However, in many instances deep excavations are not feasible. For example, commercial refineries typically require a vast array of systems (i.e., electrical systems, plumbing systems, etc.) to be implemented below ground, often time close to the surface. In such situations, deep excavation cannot be performed, and as such conventional floodwalls cannot be implemented to protect structures from floodwater damage.

One solution to the above is through the use of temporary structures that are brought to the site and set up according to their design. Many of these available temporary systems rely on "passive means" to raise flood-preventing structures. Other similar structures, such as those provided by AquaFence® (see, e.g., U.S. Pat. No. 7,121,764), implement a complex base and wall structure, which requires an array of support structures. Such temporary structures are also prone to failure after repeated use.

Thus, there is a need for a surface or shallow excavated floodwall system that is robust, strong, and effective against hydrostatic, hydrodynamic and impact loading from flooding waters on the flood walls.

SUMMARY OF THE INVENTION

One aspect of the invention relates to a floodwall shelter. According to embodiments, the floodwall shelter comprises a plurality of surface mounted floodwall sections, each section comprising: a footing having a first depth; and a wall section having a second depth, wherein the second depth is less than the first depth; a plurality of corner sections; and at least one access gate. According to one embodiment, each surface mounted floodwall section comprises concrete, wherein the concrete may be reinforced with rebar, rock, soil or combinations thereof.

According to embodiments, the plurality of surface mounted floodwall sections, the plurality of corner sections, and the at least one access gate are attached to one another with a water impermeable seal.

According to embodiments, the at least one access gate is located between two surface mounted floodwall sections and comprises: a plurality of gate abutments; a base section; a blank wall; a sliding gate panel; at least one support structure; and an actuating system. The actuating system is configured to move the sliding gate panel between an open and closed position, wherein in the closed position a watertight seal is formed around the floodwall shelter.

According to at least one embodiment, the access gate further comprises: a first seal located on a first side of the sliding gate panel; and a second seal located the at least one support structure. In the closed position the first seal is located within a notch of one of the plurality of gate abutments and the second seal abuts a second side of the sliding gate panel.

According to at least one embodiment, a plurality of roller wheels are located on a bottom side of the sliding gate panel and a guide track is located on the base section. The plurality of roller wheels are configured to mate with the guide track and allow the sliding gate panel to move between and open and closed position.

According to at least one embodiment, a guide is attached to a top surface of the sliding gate panel, and the actuating system comprises: a first motor; and a drive system connected to the guide. The motor is configured to cause the drive system to move, thereby causing the sliding gate panel to move between the open and closed positions.

According to embodiments, the floodwall shelter further comprises: a plumbing system, comprising: a plurality of pipes, at least one second motor, and at least one pump. The plumbing system is configured to transport fluid from a dry side of the floodwall shelter to a wet site of the floodwall shelter. According to one embodiment, the plurality of pipes comprises: at least one outlet pipe located through one of the plurality of surface mounted floodwall sections; and at least one inlet pipe located on the dry side. According to an embodiment, the at least one inlet pipe has a length, and at least a part of the length is perforated.

According to embodiments, the plumbing system further comprises: at least one low level switch and at least one high level switch. The high level switch is configured to activate the at least one second motor when a water level reaches a first threshold, and the low level switch is configured to deactivate the at least one second motor when a water level reaches a second threshold that is lower than the first threshold.

A second aspect of the invention relates to a method of installing at least one floodwall section. According to embodiments, the method comprises excavating a site to an excavation depth of one foot or less to create an excavation site, wherein the excavating is at a location where the at least one floodwall section will be placed; placing fill material into the excavated site; applying a top layer to the fill material to create a flat surface; and placing the at least one floodwall section on top of the top layer. The at least one floodwall section, once placed, is configured to resist flood waters without additional support structures.

According to embodiments, wherein the top layer has a larger surface area than a bottom surface of the at least one floodwall section.

According to embodiments, the method further comprises applying a seal to a wet side surface of the at least one floodwall section and the top layer. According to one embodiment, at least one floodwall section has a notch formed on the wet side surface, and applying the seal comprises filling the notch with the seal.

BRIEF DESCRIPTION OF THE DRAWINGS

The present disclosure will be further explained with reference to the attached drawing figures, wherein like structures are referred to by like numerals throughout the several views. The drawing figures shown are not necessarily to scale, with emphasis instead generally being placed upon illustrating the principles of the present disclosure, and some features may be exaggerated to show details of particular components. In addition, any measurements, specifications and the like shown in the drawing figures, or described below, are intended to be illustrative, and not restrictive. Therefore, specific structural and functional details disclosed herein are not to be interpreted as limiting, but merely as a representative basis for teaching one skilled in the art to variously employ the floodwall system, and methods thereof.

DETAILED DESCRIPTION

Figure 1:
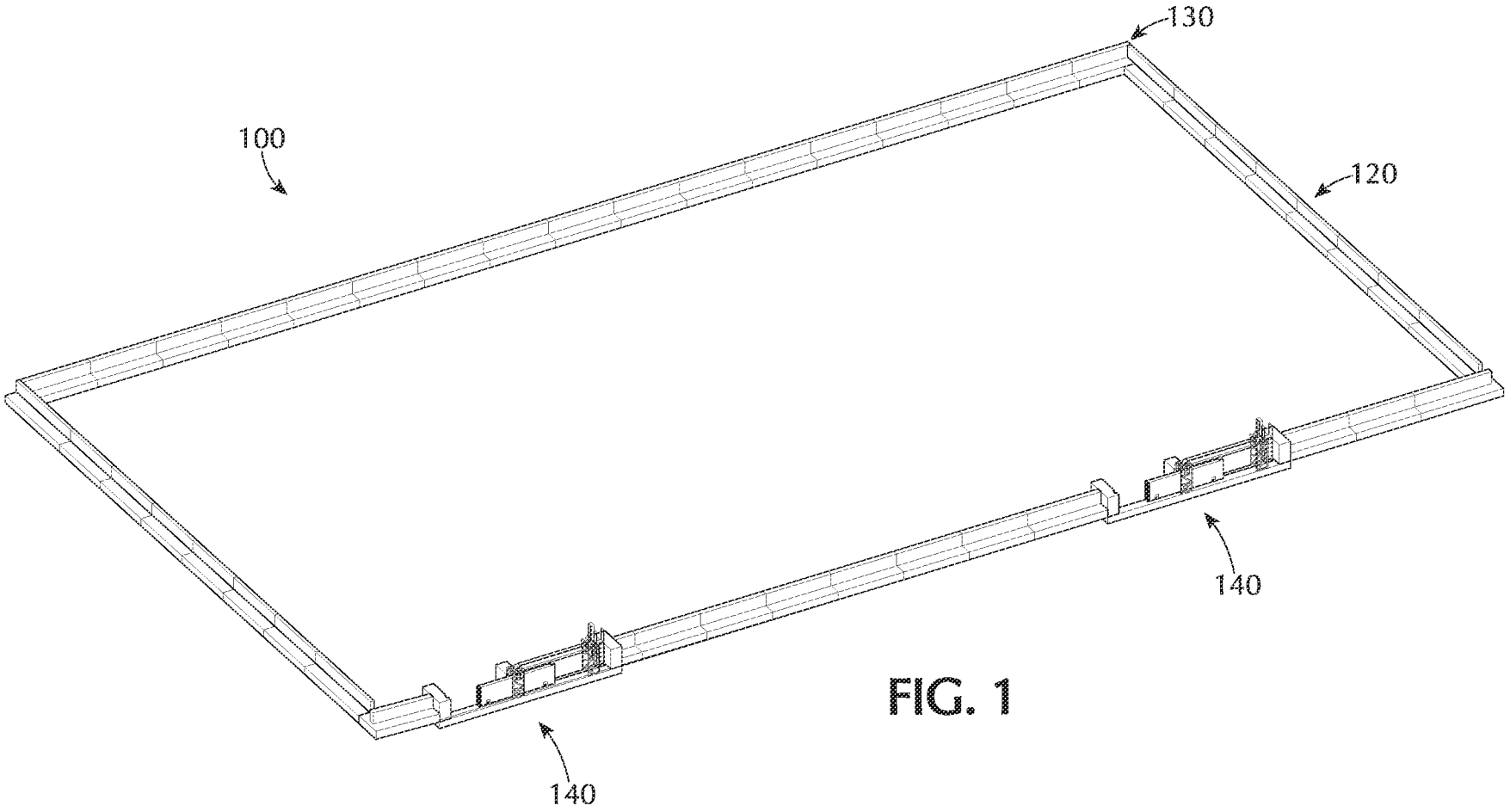
FIG. 1 depicts a flood wall shelter, according to embodiments of the invention.

According to a first aspect of the invention, FIG. 1 illustrates a floodwall shelter 100 of a static floodwall system. The floodwall shelter 100 is formed by a plurality of floodwall sections 120, a plurality of floodwall corner sections 130, and at least one access gate 140. The plurality of floodwall sections 120, corner sections 130, and access gate(s) 140 are attached with each other via a water impermeable seal, for example, by grout, and form watertight connections in order to create a continuous perimeter that protects against floodwater. The length and height of each of the floodwall sections 120, corner sections 130, and access gate(s) 140 can be varied to accommodate site conditions. As further described below, minimal excavation is required to implement the floodwall shelter 100.

Figure 2:
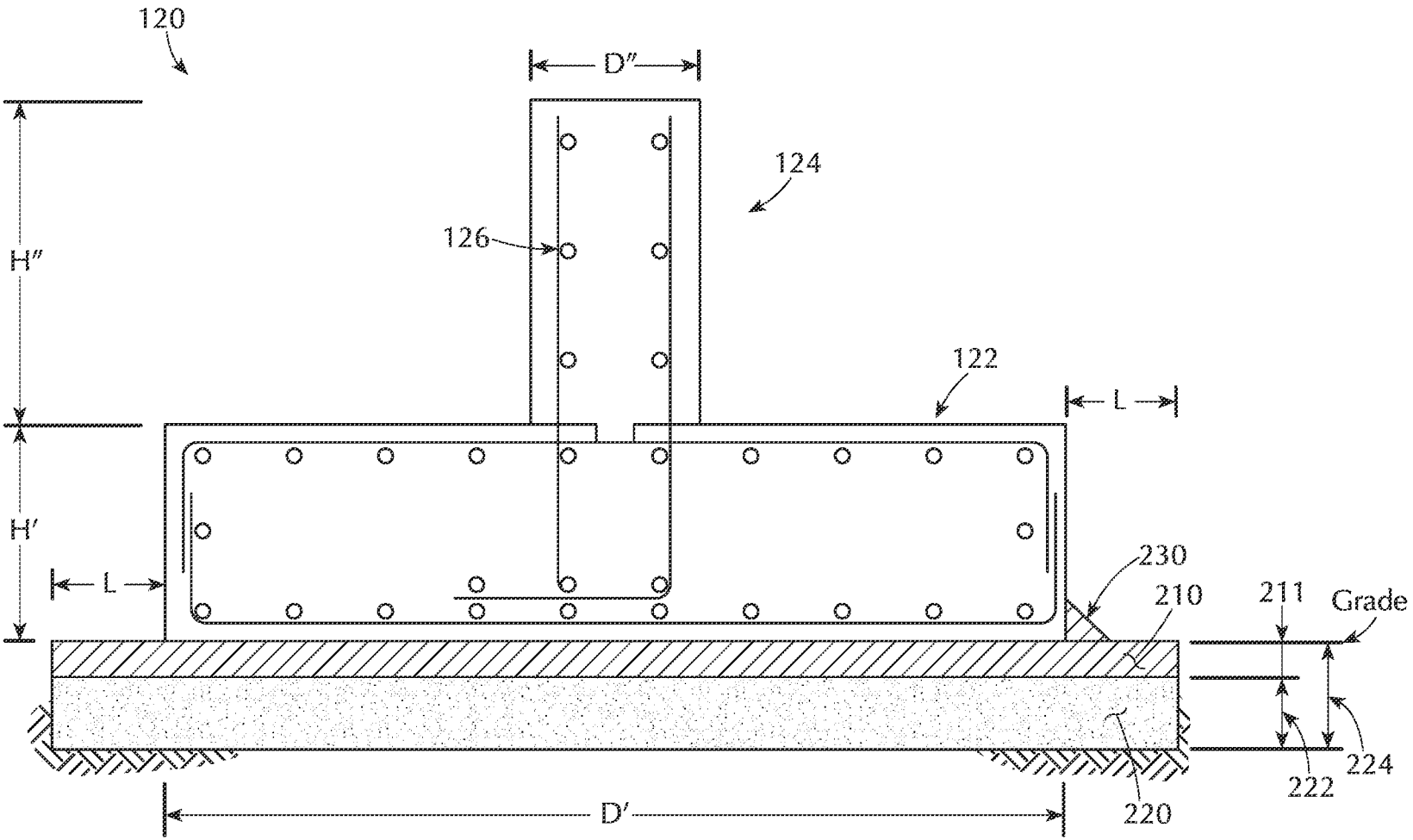
FIG. 2 depicts a cross section of a floodwall section, according to embodiments of the invention.

FIG. 2 illustrates a cross-sectional view of an individual floodwall section 120, according to embodiments of the invention. Each floodwall section 120 comprises a footing 122 and a wall section 124. The footing 122 has a depth D' and a height H', while the wall section 124 has a depth D" and a height H". The depth D' of the footing 122 is greater than the depth D" of the wall section 124. According to embodiments, the height H' of the footing 122 is less than the height H" of the wall section 124. According to one exemplary embodiment for a 5' floodwall section 120, D' is approximately 8 feet, D" is approximately 1.5 feet, H' is approximately 2 feet, and H" is approximately 3 feet. According to an alternative exemplary embodiment for a 10' floodwall section 120, D' is approximately 15 feet, D" is approximately 1.75 feet, H' is approximately 3.5 feet, and H" is approximately 6.5 feet. It is noted, according to embodiments, the ratio of the heights H'/H" and/or depths D'/D" may be selected according to ground soil conditions. For example, worse solid conditions require a deeper footing 122. The depth and height of the footing 122 also increases as the height H" is increased. It is to be noted that the ground on which the floodwall section 120 is placed should be of low permeability and have a minimum 3tsf allowable bearing. The floodwall section 120 should not be implemented on loose sand, gravel or mixtures of the two due to under seepage.

As further described below, this geometry provides a larger surface area for the floodwall section 120 to occupy on the ground, increasing the frictional force it creates with the ground when subject to floodwater forces. As further illustrated by FIG. 2, this, at least in part, allows the floodwall section 120 to be surface mounted, such that no portion of the floodwall section 120 is required to be below ground. The floodwall section may be composed of high strength concrete reinforced with rebar 126. According to alternative embodiments, the floodwall section may be composed of a jacket (e.g., a steel shell) filled with soil and/or rocks, and may be additionally filled with concrete. As further described below, each floodwall section 120 may be pre cast in a desired length and delivered to the site, cast at a desired length on site, or cast in a continuous pour on site. With such a configuration, each floodwall section includes a high surface-area footing 122, and is of a sufficient weight such that the floodwall section(s) 120 and resulting floodwall shelter 100 can adequately resist floodwater.

Each corner section 130 may comprise two floodwall sections 120 connected at an angle to one another (e.g., at 90° to create a right angle). In such embodiments the two floodwall sections 120 are attached with each other, for example, by grout. Alternatively, each corner section 120 may be a single unitary piece.

Figure 3:
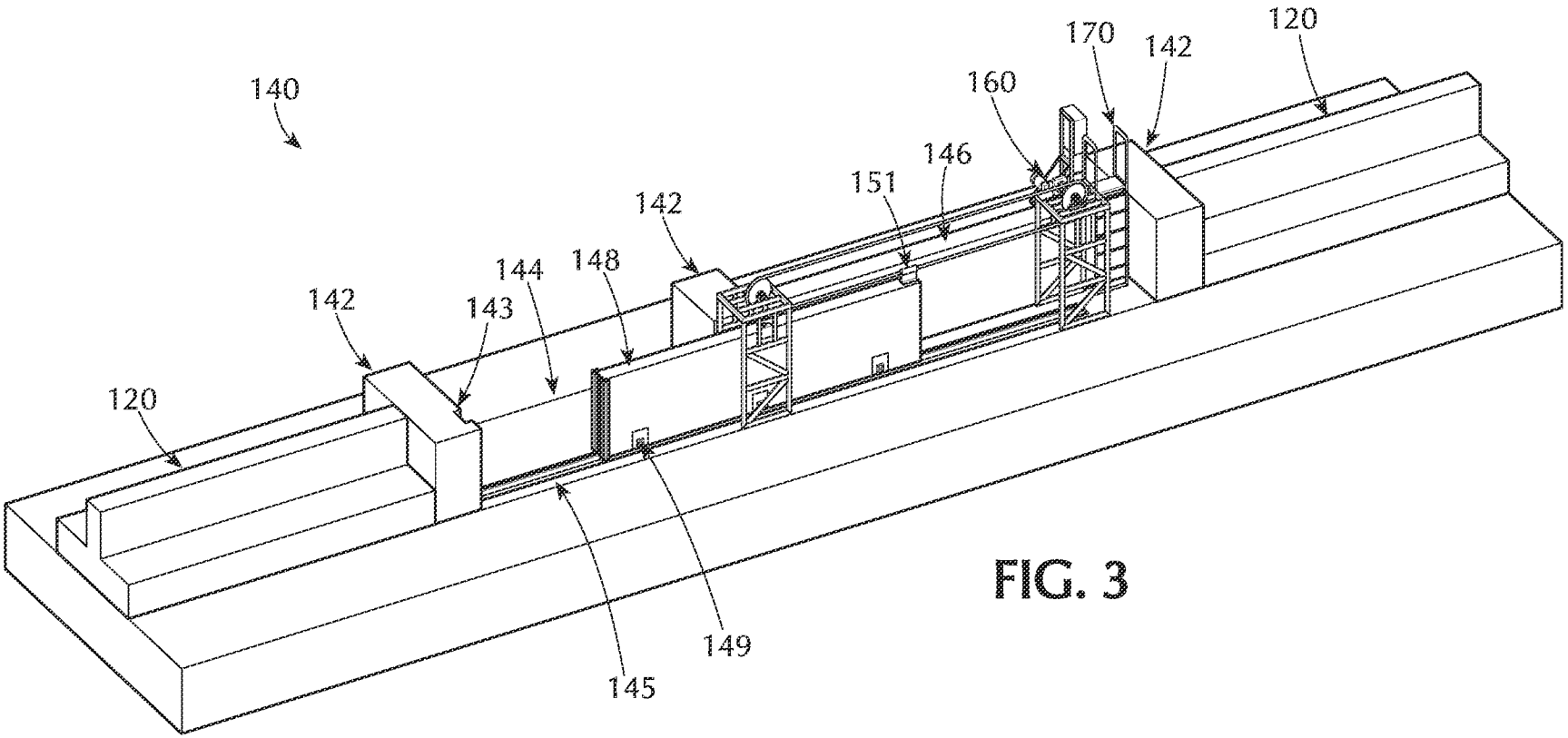
FIG. 3 depicts a front-side of an access gate, according to embodiments of the invention.
Figure 4:
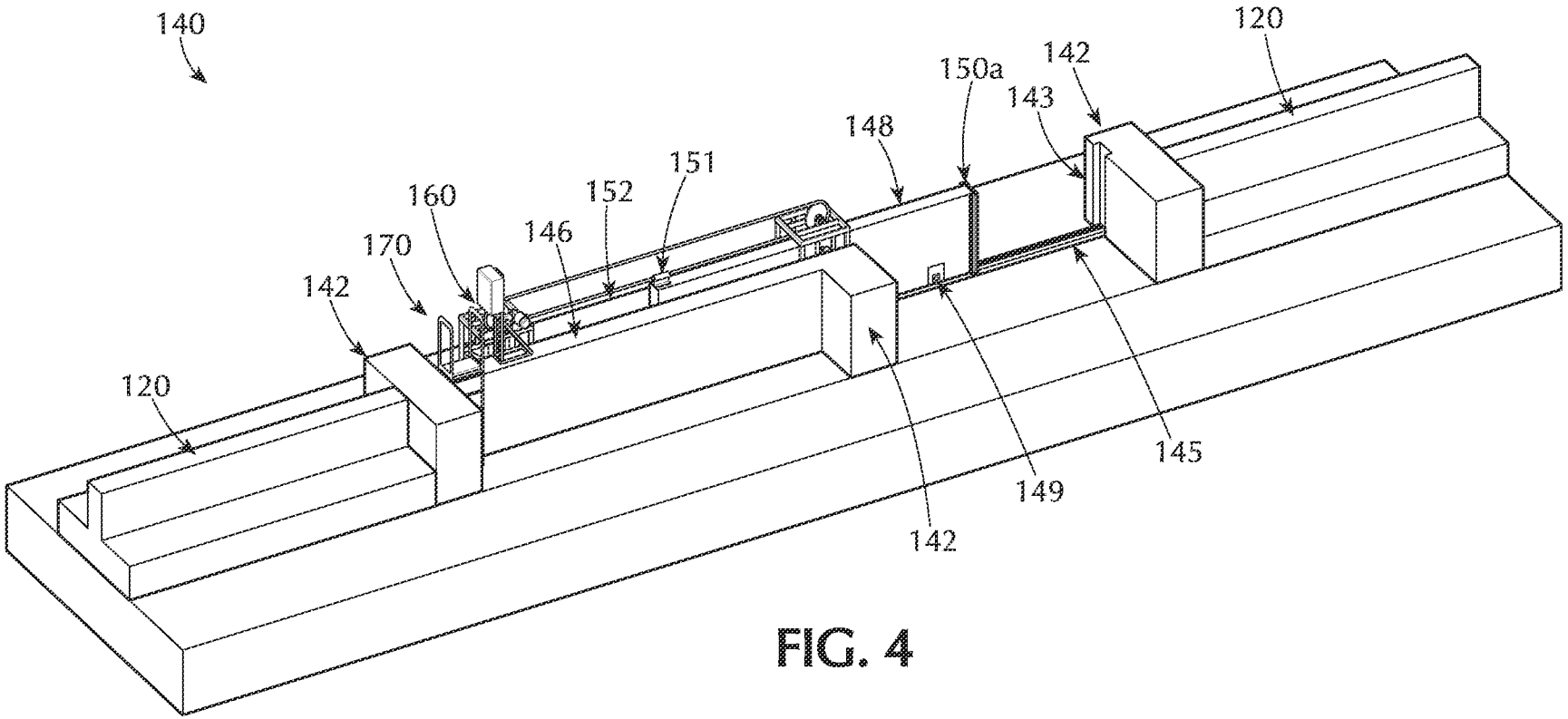
FIG. 4 depicts a back-side of an access gate, according to embodiments of the invention.

FIGS. 3 and 4 illustrate a water-side and dry-side view, respectively, of an access gate 140, according to embodiments of the invention. Each access gate 140 is located between floodwall sections 120, and has a length that can be adjusted to a desired length, such as the width of a roadway or point of egress. The access gate 140 includes gate abutments 142, a base section 144, a blank wall 146, and a sliding gate panel 148. The access gate further includes an actuating system 160 for sliding the sliding gate panel 148 between open and closed positions. As FIGS. 3 and 4 illustrate the sliding gate panel is configured to slide between an open and closed configuration, where in the closed configuration the access gate 140 creates a watertight seal between a dry side and a wet side. The gate abutments 142, base section 144, blank wall 146, and sliding gate panel 148 may similarly be composed of high strength concrete reinforced with rebar.

Figure 5:
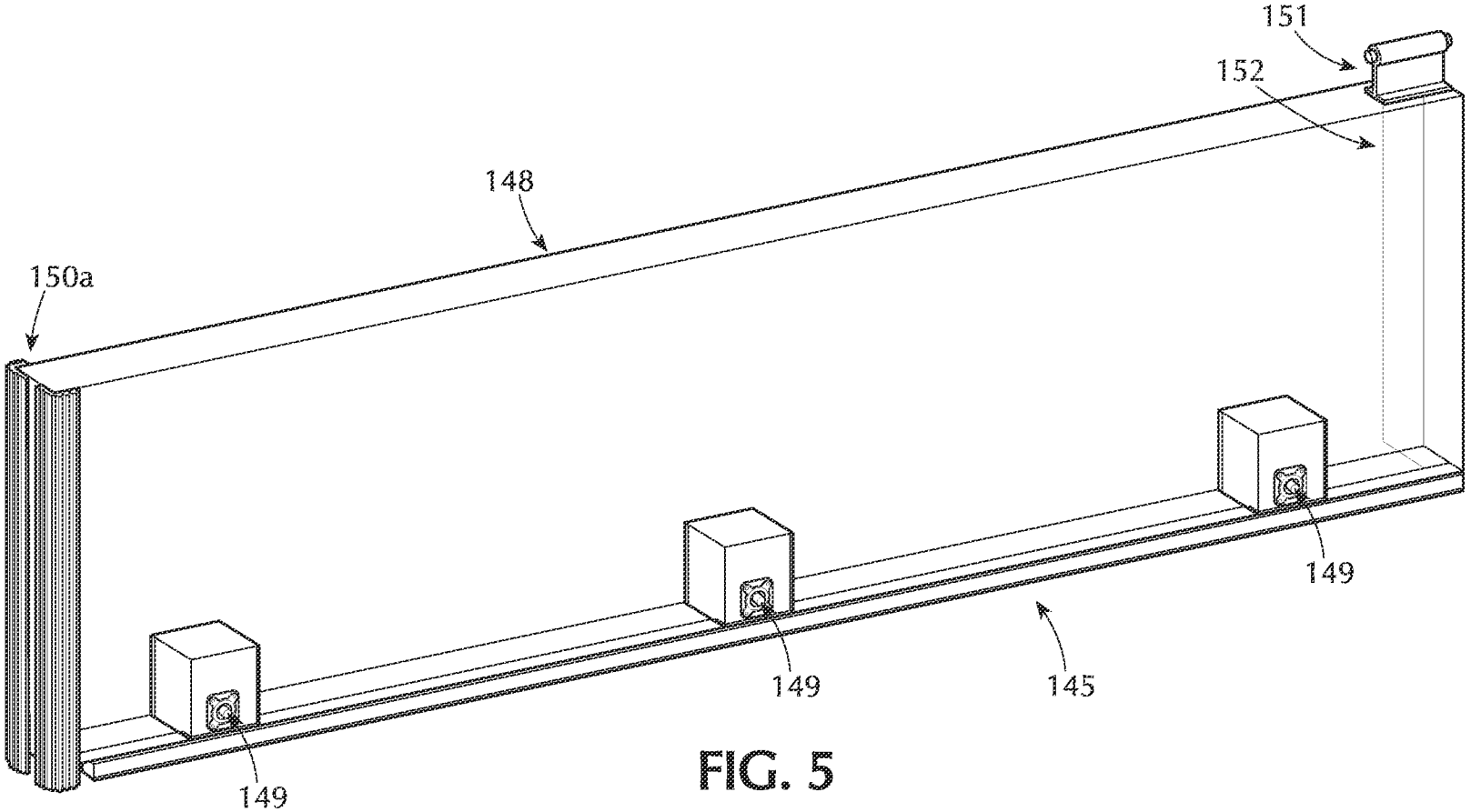
FIG. 5 depicts a gate panel of an access gate, according to embodiments of the invention.
Figure 6:
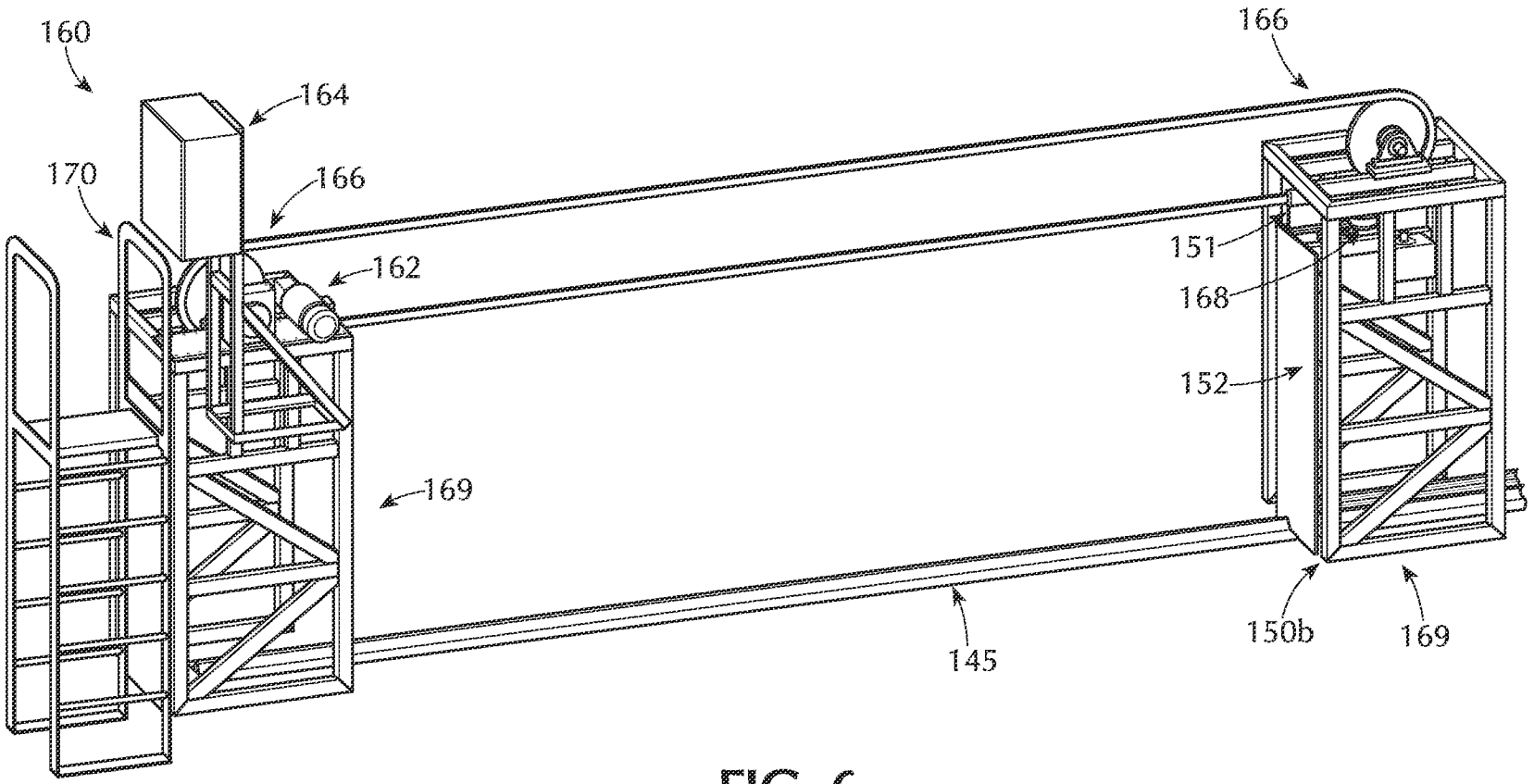
FIG. 6 depicts an actuating system for an access gate, according to embodiments of the invention.

In order to maintain a watertight seal in the closed configuration, seal 150*a* (see, e.g., FIG. 5) is located on sliding gate panel 148 and seal 150*b* is located on a surface of support structure 169 (see, e.g., FIG. 6). A first seal 150*a* is located on the leading edge of sliding gate panel 148. According to embodiments, first seal 150*a* can generally take a shape that is complementary to the shape of the leading edge of sliding gate panel 148 (see, e.g., FIG. 5). The leading edge along with first seal 150*a* is configured to fit within a corresponding notch 143 located in gate abutment 142 that acts as one end wall of the access gate (e.g., gate abutment 142 located furthest to the left in FIG. 3). A second seal 150*b* is located on a surface of one of the support structures support structure 169, and is configured to engage with trailing end abutment surface 152 of the sliding gate panel 148 (see, e.g., FIGS. 5 and 6).

As FIGS. 3-6 illustrate, second seal 150*b* creates a seal between sliding gate panel 148 and blank wall 146. According to embodiments, second seal 150*b* can generally take the shape of a flat panel that is attached to the blank wall 146 and the support structure 169. As further illustrated in FIG. 4, blank wall 146 and the central gate abutment 142 may be connected to one other, or be a continuous piece.

FIG. 5 illustrates a sliding gate panel 148 and associated structures. As mentioned above, roller wheels 149 are located within and along the bottom edge of sliding gate panel 148 and are configured to roll along guide track 145. First seal 150*a* is located on the leading edge of the sliding gate panel 148 and second seal 150*b* is located on the trailing edge. A guide 151 may be attached to the top surface, which connects to the actuating system 160, to guide sliding of the sliding gate panel 148.

Additionally, and as further described below, roller wheels 149 are located within a bottom portion of sliding gate 148, and mate with a guide track 145 (see, e.g., FIG. 6) located in the top surface of base section 144. In this way, sliding gate 148 can readily slide between a open and closed position via roller wheels 149 rolling along guide track 145.

As illustrated by FIG. 6, actuating system 160 includes a motor 162, a control box 164, a drive system 166, guide rollers 168, and support structures 169. A first of the support structures 169 supports the motor 162 and control box and a portion of drive system 166, while a second of the support structures 169 supports another portion of the drive system and the guide rollers 168. The support structures 169, as illustrated by FIG. 3 allow the sliding gate panel 148 to pass through when moving from an open to a closed position (or vis versa). Additionally, the guide track 145 is located along base section 144 such that it passes through the support structures 169. The support structures 169 are also of a sufficient height such that the motor 162, control box 164, drive system 166, and guide rollers 168 are above an expected height of the floodwater.

FIG. 6 also depicts abutment surface 152, and guide 151, which are attached to sliding gate panel 148 (omitted from this figure), and second seal 150*b*, which is attached to one of the support structures 169, to illustrate how the actuating system 160 provides the necessary force to move the sliding gate panel 148 and to ensure that when the sliding gate 148 is in a closed position a watertight seal, between the wet side and the dry side is maintained. For example, the bottom edge of abutment surface 152 has a notch formed therein to conform to the shape of guide track 145, and has a shape allowing it to abut second seal 150*b* on the surface of one of the support structures 169, when the sliding gate panel 148 is in a closed position.

As FIGS. 3-6 illustrate, motor 162, control box 164, and drive system 166 are connected to one another, while drive system 166 is connected to guide 151 that is attached to sliding gate panel 148. In order to actuate movement of sliding gate panel 148 power is provided by the control box 164 to the motor 162, which when actuated causes drive system 166 to move. According to one embodiment, drive system 166 includes two sprockets, each of which are located on a respective support structure 169, and a chain is wrapped around the sprockets. The chain, in turn, is attached to guide 151. When the motor 162 is activated it causes one of the sprockets to rotate, which causes rotation of the chain, which translates into linear movement of the guide 151 and sliding gate panel 148 along guide track 145. Roller wheels 168 guide this linear movement while also providing vertical stability to the sliding gate panel 148. According to further embodiments, the drive system 166 comprises a linear ACME screw and nut, a rack and pinion, or a belt and pulley.

A ladder 170 may also be implemented to so that aspects of the actuating system 160 are readily accessible for maintenance and the like.

Figure 7:
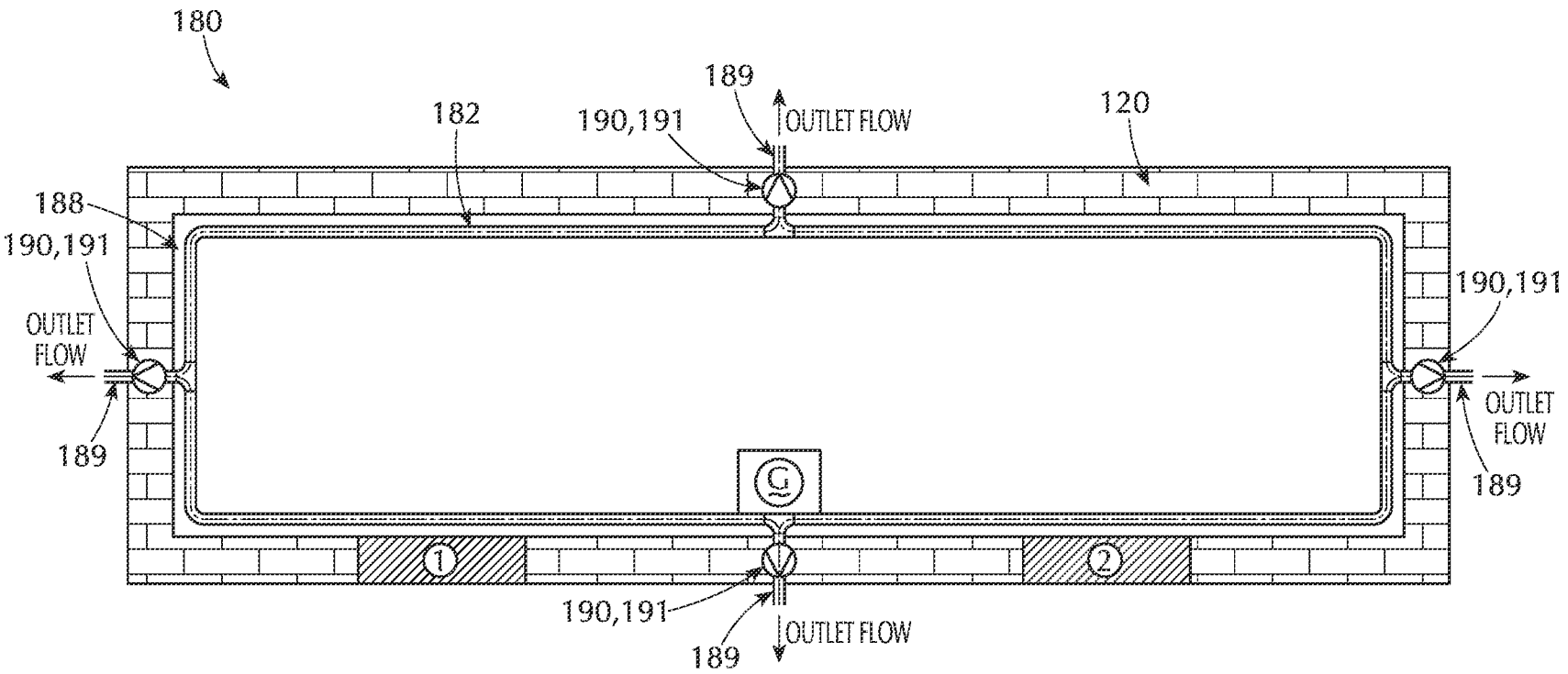
FIG. 7 depicts a plumping system for a flood wall shelter, according to embodiments of the invention.
Figure 8:
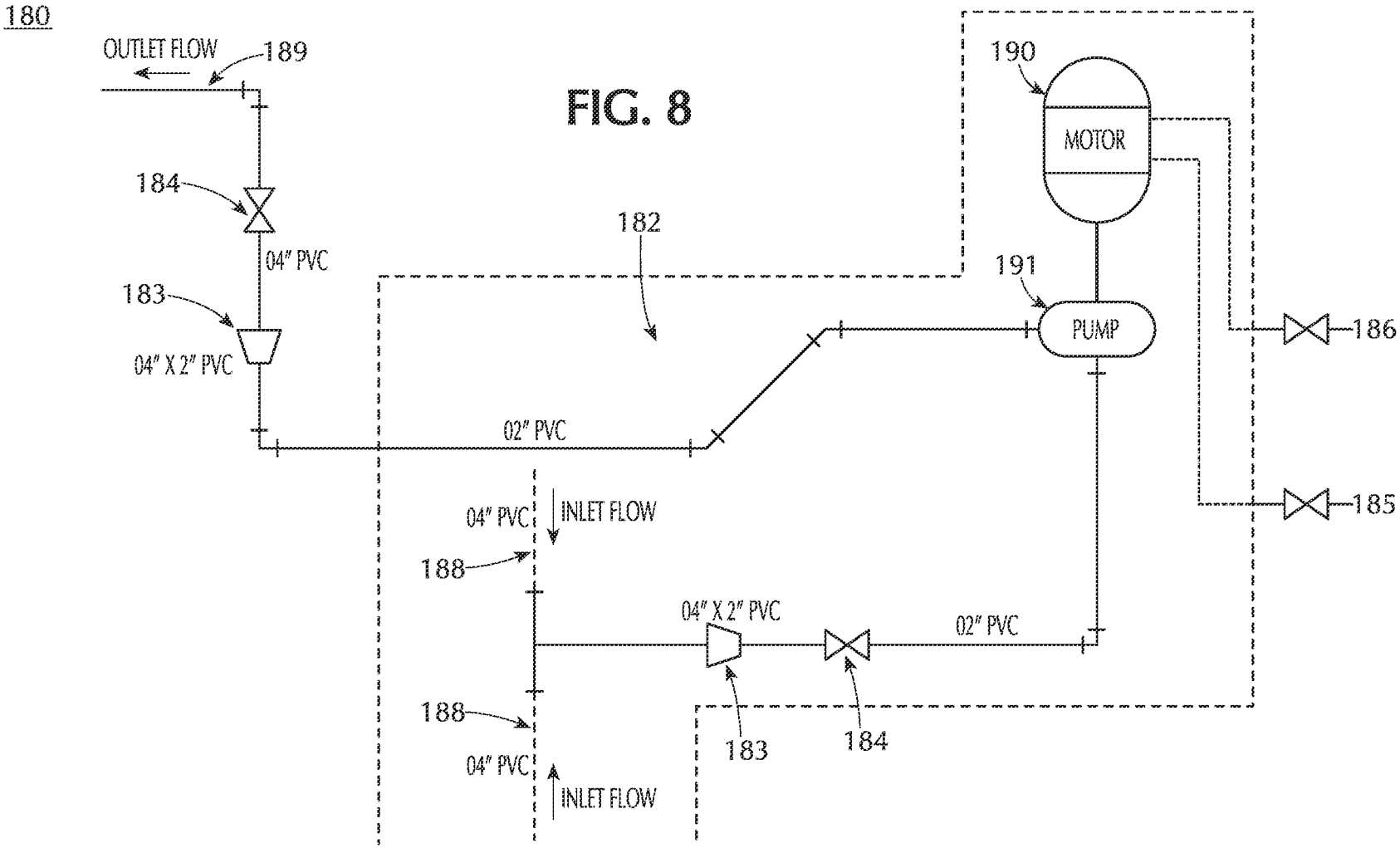
FIG. 8 depicts a line drawing of a portion of a plumping system for a flood wall shelter, according to embodiments of the invention.

A plumbing system 180 may also be provided as a part of the floodwall system, as illustrated by FIGS. 7 and 8. The plumbing system 180 may include an array of piping, at least one motor, and at least one pump, which are configured to transport any water (e.g., rain water) from the dry side back to the wet side. As FIG. 7 illustrates, plumbing system 180 includes piping 182, having at least one inlet 188, and at least one outlet 189 located through a floodwall section 120.

Along or within a floodwall section 120, of at least one side of the floodwall shelter, at least one motor 190 and pump 191 are connected to the piping to provide the necessary forces to transport any water that enters the inlet 188 through to the outlets 189. As FIG. 8 illustrates, piping 182 may include an array of pipes that connect the outlet(s) 189 to the inlet(s) 188. According to one embodiment, the inlet(s) 188 can take the form of perforated pipes (e.g., sparger pipe(s)). The perforated pipes can extend along a length of a section of the floodwall shelter 100, and connected to a solid pipe (e.g., a T pipe), which is further connected to additional piping, as well as to the at least one motor 190, pump 191, and outlet 189.

Sections of the piping 182 may have differing diameters in order to more efficiently drain water that enters the dry side of the floodwall shelter 100. According to one embodiment, piping located between the outlet 189 and inlet 188 may have a reduced diameter (e.g., 2") as compared to the piping associated with the inlet 188 and outlet 189 (e.g., 4"). In such embodiments, reducers 183 may be implemented to connect adjacent sections of piping that have differing diameters. Valves 184 may also be located along piping 182 at locations near the inlet 188 and outlet 189 in order to provide a means to cut/allow fluid flow through the plumbing system 180.

Portions of plumbing system 180, such as piping 182, may be located in a trench that surrounds the dry side (see, e.g., FIG. 7). Although FIG. 7 illustrates piping 182 as having a rectangular shape, the invention is not so limited, and other configurations are contemplated. Additionally, piping 182 does not have to completely surround the dry side. For example, each side of the floodwall shelter 100 may include its own plumbing system 180 that is not directly connected to another side. In such a configuration, each plumbing system 180 includes two linear perforated piping sections, each terminating at a different corner section. In this way each plumbing system 180 can selectively provide a means to drain water as it enters the dry side.

The plumbing system 180 may also be automated such that it is selectively activated and deactivated based on the amount of water located on the dry side. According to one embodiment, plumbing system 180 implements a low level switch 185 and a high level switch 186, that are utilized to deactivate the motor 190 and pump 191, respectively. By way of example, when rain water enters the dry side water will begin to pool within the trench that the piping 182 is located in. As pooling continues the water level will rise until it reaches a first threshold (i.e., the level of high level switch 186). Upon reaching this level, switch 186 activates motor 190 and pump 191, which causes the water to be pumped from the dry side to the wet side. As pumping continues the water level lowers until it goes below a second threshold (i.e., the level of the low level switch 185), as which point the low level switch 185 deactivates motor 190 and pump 191. In this way, plumbing system 180 ensures that a minimal amount of water is on the dry side of the floodwall shelter 100 at any given time.

Aspects of the floodwall shelter 100 may be controlled via a controller connected with the components of the system from a remote location, for example by radio signal. In this way, an operator is able to remotely control the access gate and plumbing system. According to embodiments, the floodwall shelter 100 may be controlled remotely by a controller that communicates with the floodwall system wirelessly. Upon receiving an instruction sent by the controller, a local processor controls the access gate such that it opens and closes.

Figure 9:
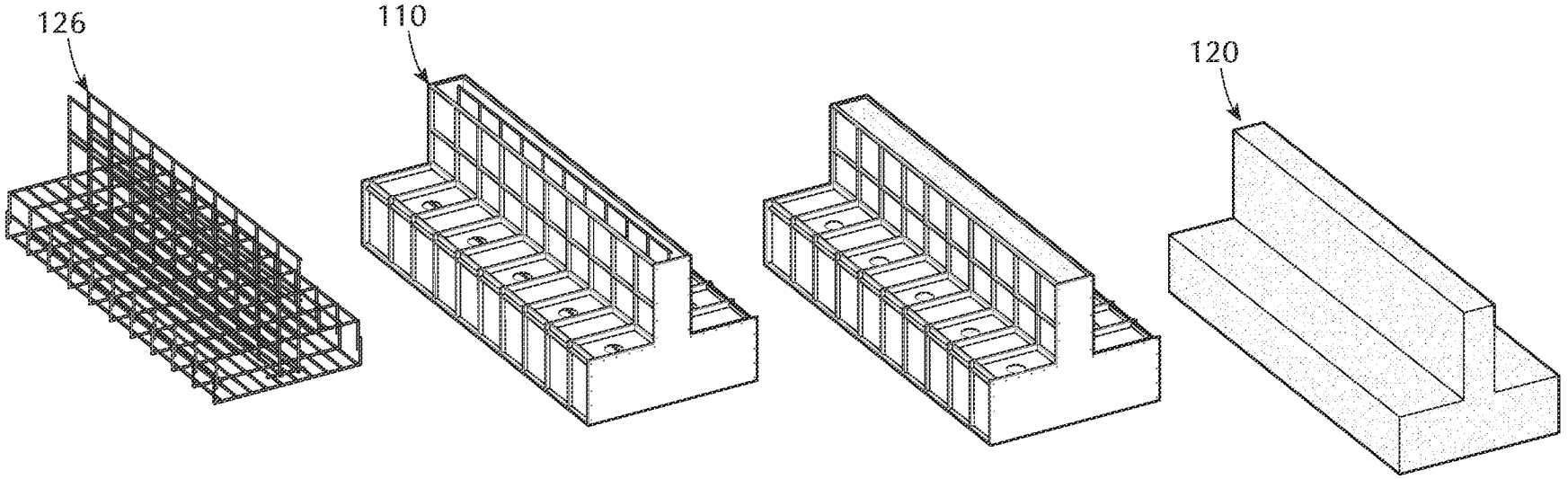
FIG. 9 depicts the process for manufacturing a floodwall section, according to embodiments of the invention.

According to a second aspect of the invention, FIG. 9 illustrates steps for the manufacture of a floodwall section 120 and/or corner section 130. According to embodiments, each floodwall section 120 and/or corner section 130 may be pre cast in a desired length and brought to the site, cast at a desired length on site, or cast in a continuous pour on site. Such a casting process, as illustrated by FIG. 9 includes forming the rebar 126 into a cage that generally mimics the desired final shape. A preform 110 is formed around the rebar 126, having an interior space that corresponds to the final shape. The preform may have an open end and vents, such that the concrete can be properly poured into the preform. Once poured, and after a sufficient drying time, the preform is removed, and the resulting floodwall section 120 and/or corner section 130 is created. Similar steps can be implemented in the creation of portions of the access gate (i.e., the gate abutments 142, the base section 144, and the blank wall 146).

Figure 10:
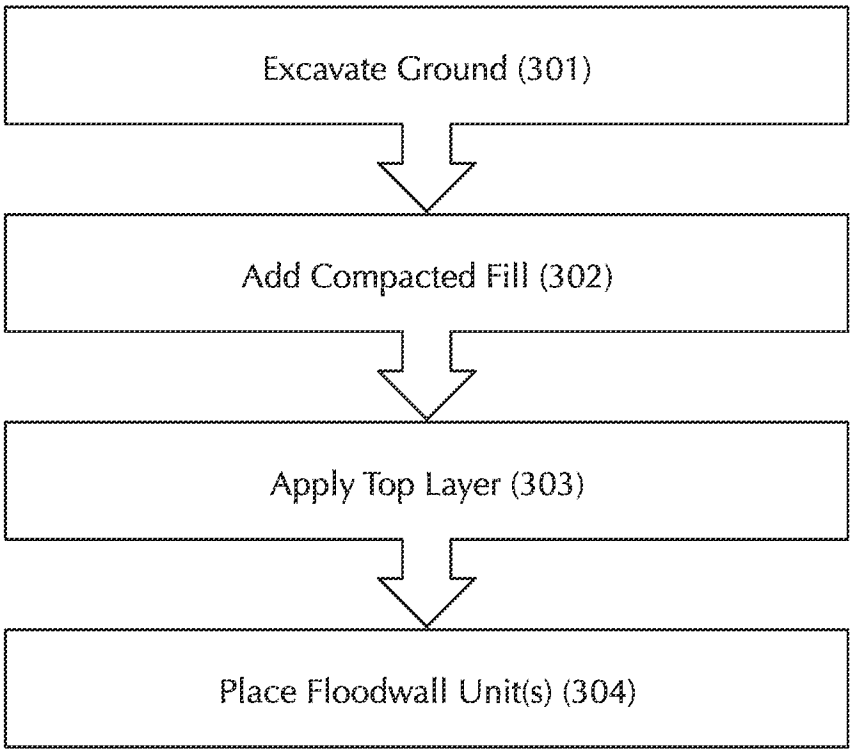
FIG. 10 depicts of method of installing a floodwall section and/or floodwall shelter, according to embodiments of the invention.

According to a third aspect of the invention, FIG. 10 illustrates methods of installing floodwall section(s) 120. As previously discussed, an advantage of the present invention relates to the surface mounted nature of the floodwall section(s) 120 and the lack of need for deep excavation. According to embodiments, minimal excavation of the target site can be achieved, and specifically, excavation to a depth of approximately 1' are contemplated by the present invention. According to a first step 301, a shallow excavation is effectuated of the ground. The excavation depth 224 (see, e.g., FIG. 2) may be as shallow as 1'. Once excavated, a second step 302 comprises placing compact fill material 220 and tamping it down within the excavation site. The compact fill material 220 has a depth 222. According to one preferred embodiment, depth 22 is approximately 8". A third step 303 comprises applying a top layer 210 of an asphalt, compliable-like material to the compact fill 220 to produce a flat surface. The top layer 210 has a depth 211, which according to one preferred embodiment is 4", such that depth 211 and depth 222 equal the excavation depth 224. Once the top layer 210 is properly placed, a floodwall section 120 is place on the top layer 210, as illustrated by FIG. 2. As FIG. 2 also illustrates, the width of the excavation (and thus the width of compact material 220 and top layer 210) is greater than the depth D' of footing 122. Thus, according to embodiments, the top layer 210 extends beyond the footprint of the floodwall sections by a distance L on both the dry side and wet side such that the top layer has a larger surface area than a bottom surface of the footing 122. According to one exemplary embodiment, L is approximately 1 foot. The result is a shallow excavated site with a surface mounted floodwall section 120 that is configured to resist floodwaters and prevent floodwater from entering the dry side without the need for any additional support structures. The compact fill material 220 in conjunction with the top layer 210 create a surface that can adequately support and distribute the weight of the floodwall section(s) 120, reduce water ingress into the ground surrounding the floodwall section(s), and aid in the amount of resistance the floodwall section(s) 120 can provide.

The area corresponding to the access gate may require deeper excavation (e.g., on the order of 2'). However, it is contemplated that the access gate(s) 140 correspond to an area where roadway(s) are already present, and as such a deeper excavation should not interfere with preexisting underground structures, as such structures would not be shallowly located under the roadway.

An additional optional step includes applying a seal 230 to the wet side. According to this step, as illustrated by FIG. 2, the seal 230 may be applied such that it adheres to a front surface (i.e., a wet side facing surface) of footing 122 as well as to the top layer 210 at an area where the front surface and the top layer meet. The seal aids in creating a watertight seal around the floodwall shelter 120. Although not specifically illustrated, the front surface of the footing may include a notch that seal 230 fills when applied to the front surface and top layer. By filling the notch the watertight seal is enhanced.

The foregoing description is given for clearness of understanding only, and no unnecessary limitations should be understood therefrom, as modifications within the scope of the invention may be apparent to those having ordinary skill in the art.

Detailed embodiments of the present invention, and methods thereof are disclosed herein; however, it is to be understood that the disclosed embodiments are merely illustrative of the floodwall system and methods thereof, and the systems and methods that may be embodied in various forms. In addition, each of the examples given in connection with the various embodiments of the systems and methods are intended to be illustrative, and not restrictive.

Throughout this specification and the claims which follow, unless the context requires otherwise, the word "comprise" and variations such as "comprises" and "comprising" will be understood to imply the inclusion of a stated integer or step or group of integers or steps but not the exclusion of any other integer or step or group of integers or steps.

Throughout the specification, where compositions are described as including components or materials, it is contemplated that the compositions can also consist essentially of, or consist of, any combination of the recited components or materials, unless described otherwise. Likewise, where methods are described as including particular steps, it is contemplated that the methods can also consist essentially of, or consist of, any combination of the recited steps, unless described otherwise. The invention illustratively disclosed herein suitably may be practiced in the absence of any element or step which is not specifically disclosed herein.

Throughout the specification, where dimensions are described in terms of ranges, it is contemplated that the ranges provide specific support for all values there within, unless described otherwise.

The practice of a method disclosed herein, and individual steps thereof, can be performed manually and/or with the aid of or automation provided by electronic equipment. Although processes have been described with reference to particular embodiments, a person of ordinary skill in the art will readily appreciate that other ways of performing the acts associated with the methods may be used. For example, the order of various steps may be changed without departing from the scope or spirit of the method, unless described otherwise. In addition, some of the individual steps can be combined, omitted, or further subdivided into additional steps.

All patents, publications and references cited herein are hereby fully incorporated by reference. In case of conflict between the present disclosure and incorporated patents, publications and references, the present disclosure should control.

The invention claimed is:

1. A floodwall shelter, comprising:

a plurality of surface mounted floodwall sections, each section comprising:

a footing having a first depth; and a wall section having a second depth, wherein the second depth is less than the first depth;

a plurality of corner sections; and at least one access gate;

wherein no portion of any floodwall section extends below ground; and wherein the at least one access gate is located between two surface mounted floodwall sections and comprises:

a plurality of gate abutments;

a base section;

a blank wall;

a sliding gate panel;

at least one support structure; and an actuating system.

2. The floodwall shelter of claim 1, wherein each surface mounted floodwall section comprises concrete.

3. The floodwall shelter of claim 2, wherein the concrete is reinforced with rebar.

4. The floodwall shelter of claim 3, wherein the concrete is reinforced with rock or soil.

5. The floodwall shelter of claim 1, wherein the plurality of surface mounted floodwall sections, the plurality of corner sections, and the at least one access gate are attached to one another with a water impermeable seal.

6. The floodwall shelter of claim 1, wherein the actuating system is configured to move the sliding gate panel between an open and closed position, and wherein in the closed position a watertight seal is formed around the floodwall shelter.

7. The floodwall shelter of claim 6, wherein the access gate further comprises:

a first seal located on a first side of the sliding gate panel; and a second seal located the at least one support structure.

8. The floodwall shelter of claim 7, wherein in the closed position the first seal is located within a notch of one of the plurality of gate abutments and the second seal abuts a second side of the sliding gate panel.

9. The floodwall shelter of claim 6, further comprising:

a guide attached to a top surface of the sliding gate panel, wherein the actuating system comprises:

a first motor; and a drive system connected to the guide; and wherein the motor is configured to cause the drive system to move, thereby causing the sliding gate panel to move between the open and closed positions.

10. The floodwall shelter of claim 1, further comprising:

a plurality of roller wheels located on a bottom side of the sliding gate panel; and a guide track located on the base section, wherein the plurality of roller wheels are configured to mate with the guide track and allow the sliding gate panel to move between and open and closed position.

11. The floodwall shelter of claim 1, further comprising:

a plumbing system, comprising:

a plurality of pipes;

at least one first motor; and at least one pump;

wherein the plumbing system is configured to transport fluid from a dry side of the floodwall shelter to a wet site of the floodwall shelter.

12. The floodwall shelter of claim 11, wherein the plurality of pipes comprises:

at least one outlet pipe located through one of the plurality of surface mounted floodwall sections; and at least one inlet pipe located on the dry side.

13. The floodwall shelter of claim 12, wherein the at least one inlet pipe has a length, and wherein at least a part of the length is perforated.

14. A method of installing at least one floodwall section, comprising:

excavating a site to an excavation depth of one foot or less to create an excavation site, wherein the excavating is at a location where the at least one floodwall section will be placed;

placing fill material into the excavated site;

applying a top layer to the fill material to create a flat surface; and placing the at least one floodwall section on top of the top layer, wherein the at least one floodwall section, once placed, is configured to resist flood waters without additional support structures;

wherein no portion of any floodwall section extends below ground;

wherein the at least one floodwall section comprises at least a first floodwall section and a second floodwall section, the first floodwall section and the second floodwall section each separately being one of the plurality of surface mounted floodwall sections of claim 1; and wherein the first floodwall section and the second floodwall section are cast in a continuous pour on site.

15. The method of installing at least one floodwall section of claim 14, wherein the top layer has a larger surface area than a bottom surface of the at least one floodwall section.

16. The method of installing at least one floodwall section of claim 14, further comprising:

applying a seal to a wet side surface of the at least one floodwall section and the top layer.

17. The method of installing at least one floodwall section of claim 16, wherein at least one floodwall section has a notch formed on the wet side surface, and wherein applying the seal comprises filling the notch with the seal.

18. The method of installing at least one floodwall section of claim 14, wherein the at least one floodwall section is one of the plurality of surface mounted floodwall sections of claim 1.

19. The method of installing at least one floodwall section of claim 14, wherein the first floodwall section has a first height, the second floodwall section has a second height, and the first height is not equal to the second height.

20. A floodwall shelter of claim 11, comprising:

a plurality of surface mounted floodwall sections, each section comprising:

a footing having a first depth; and a wall section having a second depth, wherein the second depth is less than the first depth;

a plurality of corner sections;

at least one access gate;

a plumbing system, comprising:

a plurality of pipes;

at least one first motor; and at least one pump;

wherein no portion of any floodwall section extends below ground;

wherein the plumping system is configured to transport fluid from a dry side of the floodwall shelter to a wet side of the floodwall shelter;

wherein the plumbing system further comprises:

at least one low level switch; and at least one high level switch, wherein the high level switch is configured to activate the at least one second motor when a water level reaches a first threshold; and wherein the low level switch is configured to deactivate the at least one second motor when a water level reaches a second threshold that is lower than the first threshold.

21. A floodwall shelter, comprising:

a plurality of surface-mounted floodwall sections, each section comprising:

a footing having a first depth; and a wall section having a second depth, wherein the second depth is less than the first depth;

a plurality of corner sections; and at least one access gate;

wherein:

no portion of any floodwall section extends below ground;

the plurality of surface mounted floodwall sections comprises at least a first floodwall section and a second floodwall section; and the first floodwall section and the second floodwall section are cast in a continuous pour on site.

22. The floodwall shelter of claim 21, wherein the first floodwall section has a first height, the second floodwall section has a second height, and the first height is not equal to the second height.

* * * * *